US008734142B2

(12) United States Patent
Kiem et al.

(10) Patent No.: US 8,734,142 B2
(45) Date of Patent: May 27, 2014

(54) ROTATION PREVENTING MEMBER OF A SCROLL COMPRESSOR

(75) Inventors: Myungkyun Kiem, Changwon-Si (KR); Taesoon Choi, Changwon-Si (KR); Ikseo Park, Changwon-Si (KR)

(73) Assignee: LG Electrnics Inc., Seoul (KR)

( * ) Notice: Subject to any disclaimer, the term of this patent is extended or adjusted under 35 U.S.C. 154(b) by 194 days.

(21) Appl. No.: 13/407,232

(22) Filed: Feb. 28, 2012

(65) Prior Publication Data

US 2013/0004355 A1 Jan. 3, 2013

(30) Foreign Application Priority Data

Jul. 1, 2011 (KR) ..... 10-2011-0065638

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |

(52) U.S. Cl.

USPC ..... 418/55.3; 418/56.1; 418/55.5; 418/57; 464/102

(58) Field of Classification Search

USPC ..... 418/55.1–55.6, 57; 464/102

See application file for complete search history.

(56) References Cited

U.S. PATENT DOCUMENTS

| | | | | |
|---|---|---|---|---|
| 4,637,786 | A * | 1/1987 | Matoba et al. | 418/55.3 |
| 5,899,676 | A * | 5/1999 | Iizuka | 418/55.3 |

FOREIGN PATENT DOCUMENTS

| | | | |
|---|---|---|---|
| JP | 58-85387 | A | 5/1983 |
| JP | 61-113987 | U | 7/1986 |
| JP | 4-36084 | A | 2/1992 |
| KR | H04-066791 | | 3/1992 |

* cited by examiner

*Primary Examiner* — Theresa Trieu

(74) *Attorney, Agent, or Firm* — McKenna Long & Aldridge LLP

(57) ABSTRACT

Disclosed is a scroll compressor. As two side surfaces of a rotation preventing member are formed to be flat with keys, the rotation preventing member, a main frame, and an orbiting scroll may be easily processed and partial frictions and noise due to the keys may be prevented. Furthermore, since the orbiting scroll is entirely and stably supported by a ring portion of the rotation preventing member, the occurrence of a tilting moment of the orbiting scroll may be reduced. This may enhance the stability and the performance of the scroll compressor.

11 Claims, 8 Drawing Sheets

ROTATION PREVENTING MEMBER OF A SCROLL COMPRESSOR

CROSS-REFERENCE TO RELATED APPLICATIONS

The present disclosure relates to subject matter contained in priority Korean Application No. 10-2011-0065638, filed on Jul. 1, 2011, which is herein expressly incorporated by reference in its entirety.

BACKGROUND OF THE INVENTION

1. Field of the Invention

The present invention relates to an orbiting scroll, and more particularly, to a rotation preventing member of a scroll compressor.

2. Description of the Related Art

Generally, a compressor is an apparatus for compressing fluid such as a refrigerant gas, and may be classified into a rotary compressor, a reciprocating compressor, a scroll compressor, etc. according to a fluid compression method.

This scroll compressor indicates a compressor of a high efficiency and low noise, the compressor widely applied to an air conditioning system. In this scroll compressor, a plurality of compression chambers are formed between two scrolls as the two scrolls perform an orbital motion with respect to each other. While continuously moving toward the center, these compression chambers have a deceased volume. Accordingly, a refrigerant is sucked, compressed and then is discharged.

FIG. 1 is a longitudinal sectional view illustrating one example of a scroll compressor in accordance with the conventional art, and FIG. 2 is a perspective view illustrating a state that an Oldham's ring has been separated from a main frame and an orbiting scroll of FIG. 1.

As shown, in the conventional scroll compressor, a main frame 2 and a sub frame 3 are disposed at an inner space 11 of a casing 1 with a predetermine gap therebetween in a horizontal direction. A driving motor 4 for generating a rotational force is installed between the main frame 2 and the sub frame 3. To the center of a rotor 42 of the driving motor 4, coupled is a crankshaft 5 passing through the main frame 2, and configured to transmit a rotational force of the driving motor 3 to an orbiting scroll 7 to be later explained by being coupled thereto. The main frame 2 is forcibly-coupled to the casing 1, and the sub frame 3 is integrally formed with the casing 1.

A fixed scroll 6 is fixedly-installed above the main frame 2, and the orbiting scroll 7 is coupled to the fixed scroll 6 to form a pair of compression chambers (P) which consecutively move, by being engaged with the fixed scroll 6. Between the orbiting scroll 7 and the main frame 2, installed is an Oldham's ring 8 for allowing the orbiting scroll 7 to perform an orbital motion with preventing a rotation of the orbiting scroll 7.

A suction pipe 12 and a discharge pipe 13 are coupled to the casing 1. The suction pipe 12 is directly communicated with a suction ort (not shown) via the casing 1, whereas the discharge pipe 13 is communicated with the inner space 11 of the casing 1. A discharge port 63 of the fixed scroll 6 for containing therein a discharge refrigerant is communicated with the inner space 11 of the casing 1.

A shaft accommodating hole 21 for supporting a crankshaft 5 in a radius direction is formed at the center of the main frame 2, and a first bearing 22 for supporting the crankshaft 5 in a radius direction is installed at the shaft accommodating hole 21.

The crankshaft 5 is forcibly-inserted into the rotor 42 of the driving motor 4, and upper and lower sides thereof are supported by the main frame 2 and the sub frame 3, respectively. Inside the crankshaft 5, an oil passage 51 is long formed along a shaft direction so that oil of the casing 1 may be sucked to be used to lubricate each bearing surface.

A fixed wrap 62 which forms a pair of compression chambers (P) is formed on a bottom surface of an end plate 61 of the fixed scroll 6 in an involute shape. A suction port (not shown) directly connected to the suction pipe 12 and sucking a refrigerant into the compression chambers (P) is formed on a side surface of the end plate 61. At the center of an upper surface of the end plate 61, formed is the discharge port 63 through which a compression gas compressed in the compression chambers (P) is discharged to the inner space 11 of the casing 1. On an upper surface of the fixed scroll 6, provided is a check valve 9 opening or closing the discharge port 63 and preventing backflow of a refrigerant gas.

On an upper surface of an end plate 71 of the orbiting scroll 7, an orbiting wrap is formed in an involute shape so as to form the pair of compression chambers (P) together with the fixed wrap 62 of the fixed scroll 6. At the center of a bottom surface of the end plate 71, formed is a boss portion 73 coupled to the crankshaft 5 and receiving a driving force of the driving motor 4. On an inner circumferential surface of the boss portion 73, installed is a second bearing 74 for supporting the crankshaft 5 and the boss portion 73 in a radius direction.

As shown in FIG. 2, a body of the Oldham's ring 8, a ring portion 81 is formed in a ring shape. At two sides of an upper surface of the ring portion 81, first keys 82 are radially formed so as to be slidably inserted into first key recesses 75 provided on a bottom surface of the end plate 71 of the orbiting scroll 7. At two sides of a bottom surface of the ring portion 81, second keys 83 are formed so as to be slidably inserted into second key recesses 23 of the main frame in a direction perpendicular to the first keys 82.

Unexplained reference numeral 31 denotes a third bearing for supporting the crankshaft in a radius direction, and 41 denotes a stator of the driving motor.

The conventional scroll compressor is operated as follows.

Once power is applied to the driving motor 4, the orbiting scroll 7 performs an orbital motion on an upper surface of the main frame 2 by the Oldham's ring 8 by an eccentric distance while the crank shaft 5 rotates together with the rotor 42 of the driving motor 4. And, the pair of compression chambers (P) which consecutively move are formed between the fixed wrap 62 and an orbiting wrap 72. The compression chambers (P) move toward the center by the continuous orbital motion of the orbiting scroll 7, thus to have a decreased volume. Accordingly, a refrigerant is sucked, compressed and then is discharged.

The first keys 82 and the second keys 83 of the Oldham's ring 8 disposed between an upper surface of the main frame 2 and a bottom surface of the orbiting scroll 7 are slidably inserted into the first key recesses 75 of the orbiting scroll 7 and the second key recesses 23 of the main frame 2, respectively, in a direction perpendicular to each other. This may prevent the orbiting scroll 7 having received a rotational force of the driving motor 4 from rotating with respect to the fixed scroll 6.

However, in the conventional scroll compressor, processing the Oldham's ring 8 is difficult due to the first keys 82 and the second keys 83. Besides, the first key recesses 75 and the second key recesses 23 for slidably inserting the first keys 82 and the second keys 83 have to be formed at the orbiting scroll 7 and the main frame 2, respectively. This may increase the fabrication costs of the orbiting scroll 7 and the main frame 2.

Besides, since the orbiting scroll 7 is supported by the main frame 2 by the first keys 82 and the second keys 83 of the Oldham's ring 8, a supportable area may be narrowed. If a tilting moment may occur at the orbiting scroll 7, the Oldham's ring 8 may be easily inclined to tilt the orbiting scroll 7. This may lower the stability and the performance of the scroll compressor, and may increase partial frictions and noise between the orbiting scroll 7 and the main frame 2 or between the orbiting scroll 7 and the fixed scroll 6.

SUMMARY OF THE INVENTION

Therefore, an object of the present invention is to provide a scroll compressor capable of facilitating fabrications due to a simplified structure of a rotation preventing member, and capable of reducing fabrication costs of the rotation preventing member and components contacting the rotation preventing member.

Another object of the present invention is to provide a scroll compressor capable of effectively overcoming a tilting moment occurring at an orbiting scroll.

To achieve these and other advantages and in accordance with the purpose of the present invention, as embodied and broadly described herein, there is provided a scroll compressor, comprising: a rotation preventing member disposed between a fixed member and a movable member, and configured to prevent a rotation of the movable member, and configured to allow the movable member to perform an orbital motion with respect to the fixed member, wherein the rotation preventing member comprises a ring portion formed in a ring shape; one or more first sliding surfaces formed on an inner circumferential surface or an outer circumferential surface of the ring portion in a first direction, and slidably coupled to the movable member; and a second sliding surface formed, in a second direction, on one of the inner circumferential surface and the outer circumferential surface of the ring portion where the first sliding surface is not formed, and slidably coupled to the fixed member, wherein a virtual line extending from the first sliding surface and a virtual line extending from the second sliding surface are formed to cross each other.

According to another aspect of the present invention, there is provided a scroll compressor, comprising: a frame fixedly-installed at an inner space of a casing; a fixed scroll fixedly-installed at the frame; an orbiting scroll installed to be movable with respect to the fixed scroll, and coupled to a rotor of a driving motor; and a rotation preventing member disposed between the frame and the orbiting scroll or between the fixed scroll and the orbiting scroll, and configured to prevent a rotation of the orbiting scroll, wherein a first guide surface is formed at the frame or the fixed scroll, a second guide surface is formed at the orbiting scroll, a first sliding surface is formed on one of an inner circumferential surface and an outer circumferential surface of the rotation preventing member so as to slidably contact the first guide surface, and a second sliding surface is formed on another surface so as to slidably contact the second guide surface.

DETAILED DESCRIPTION OF THE INVENTION

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a drain device and a refrigerator having the same according to an embodiment, with reference to the accompanying drawings.

Hereinafter, a scroll compressor of the present invention will be explained in more details with reference to the attached drawings.

Figure 1:
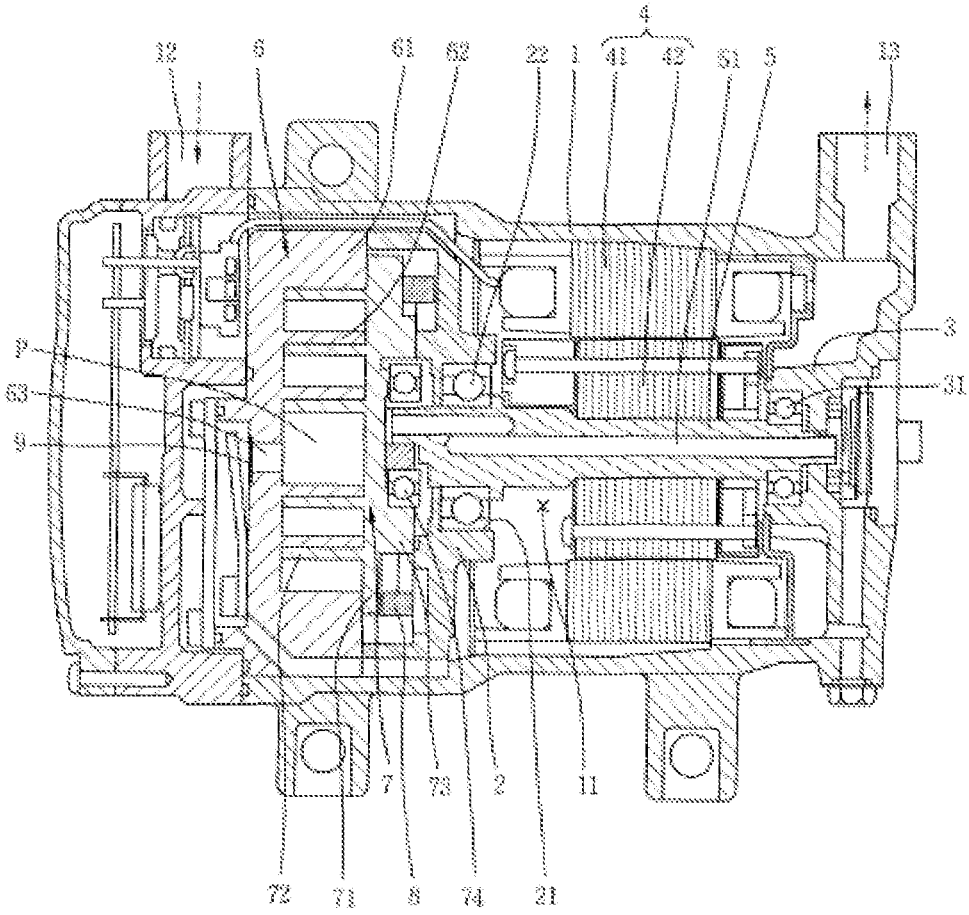
FIG. 1 RELATED ART
FIG. 1 is a longitudinal sectional view illustrating one example of a scroll compressor in accordance with the conventional art.
Figure 2:
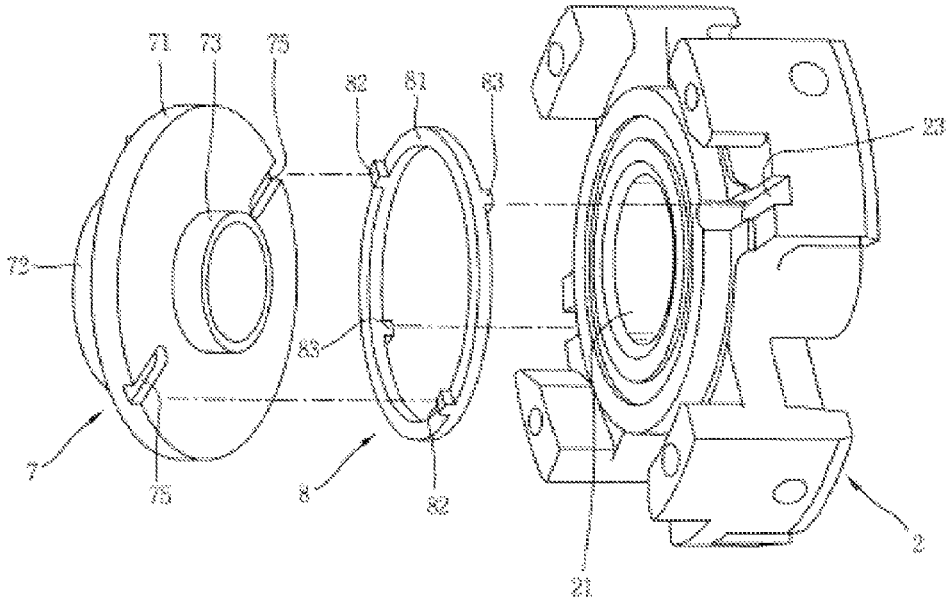
FIG. 2 RELATED ART
FIG. 2 is a perspective view illustrating a state that an Oldham's ring has been separated from a main frame and an orbiting scroll of FIG. 1.
Figure 3:
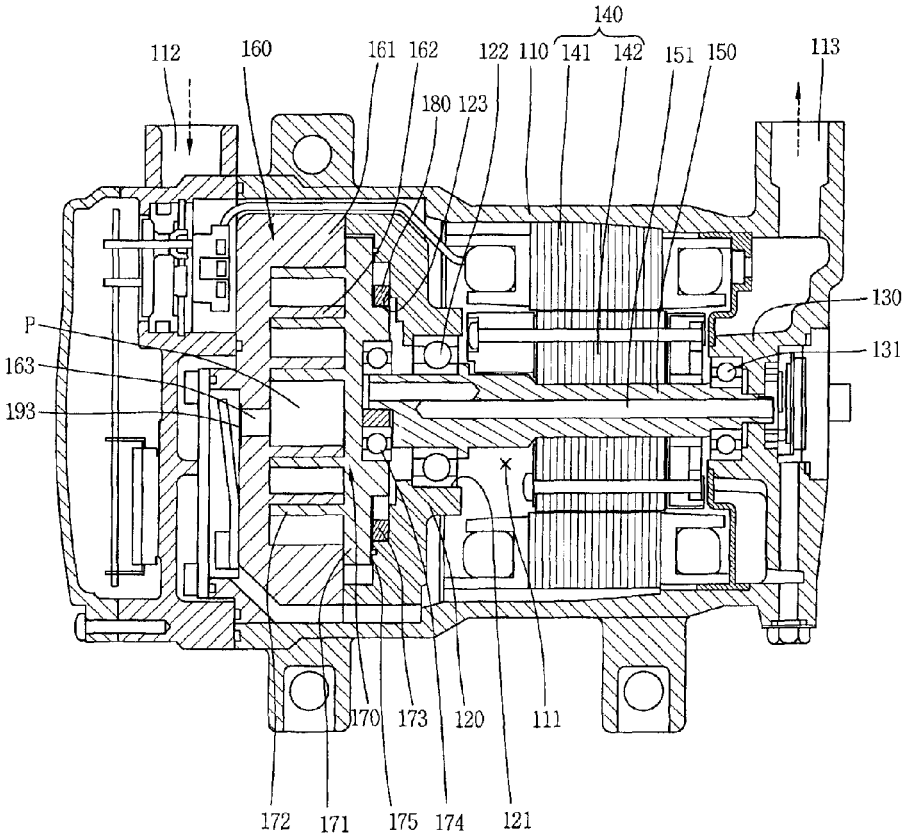
FIG. 3 is a longitudinal sectional view illustrating one example of a scroll compressor according to the present invention.
Figure 4:
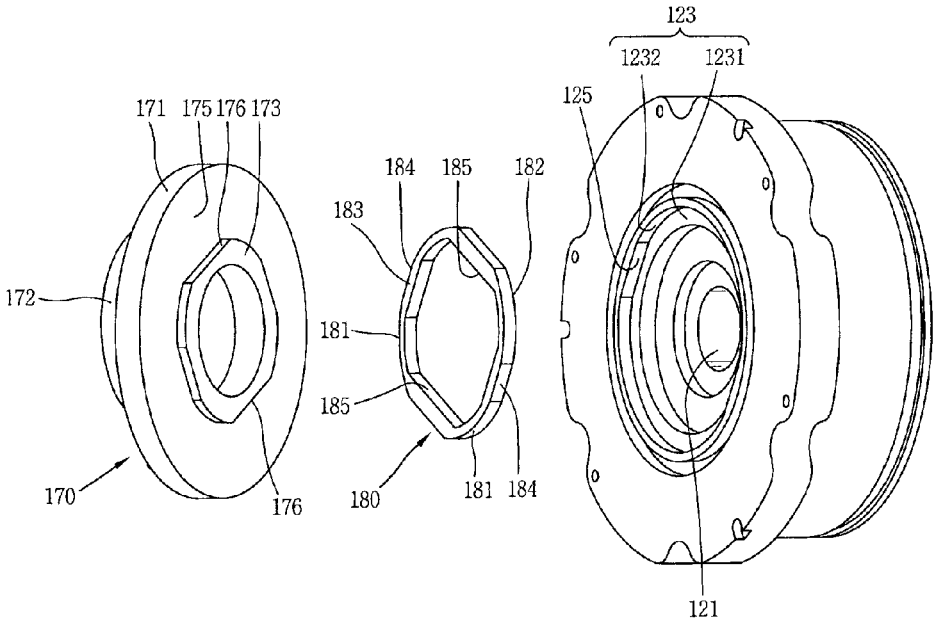
FIG. 4 is a perspective view illustrating a state that a rotation preventing member has been separated from a main frame and an orbiting scroll of the scroll compressor of FIG. 3.
Figure 5:
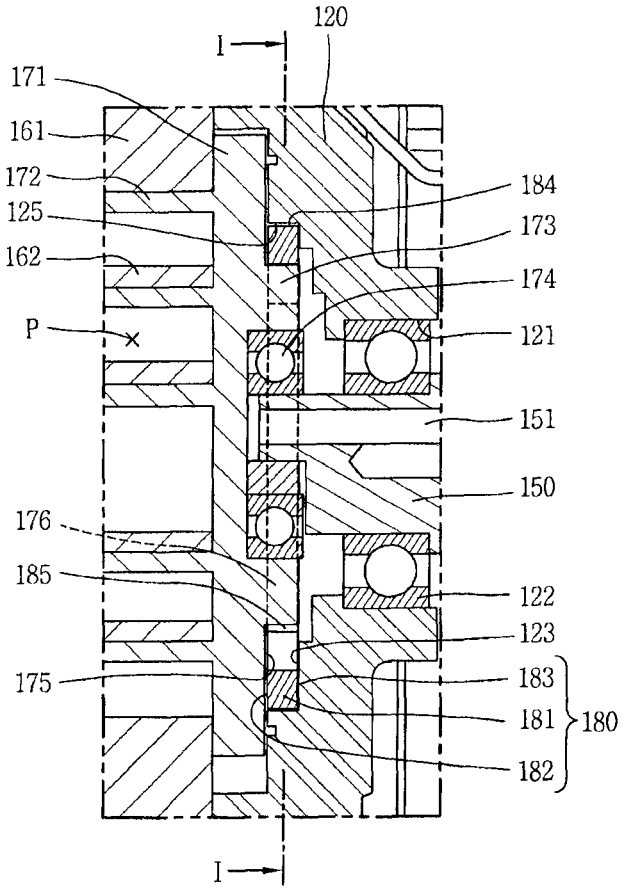
FIG. 5 is a perspective view illustrating a state that a rotation preventing member has been interposed between a main frame and an orbiting scroll of the scroll compressor of FIG. 3.
Figure 6:
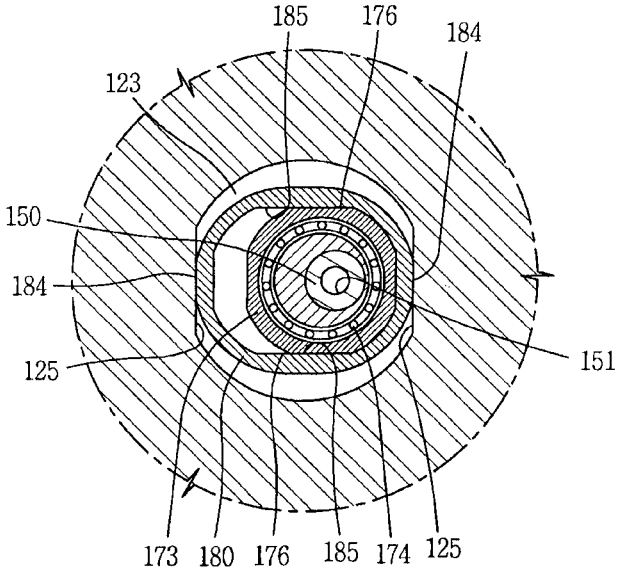
FIG. 6 is a sectional view taken along line 'I-I' in FIG. 5, which illustrates a state that a rotation preventing member has been interposed between a main frame and an orbiting scroll.

FIG. 3 is a longitudinal sectional view illustrating one example of a scroll compressor according to the present invention, FIG. 4 is a perspective view illustrating a state that a rotation preventing member has been separated from a main frame and an orbiting scroll of the scroll compressor of FIG. 3, FIG. 5 is a perspective view illustrating a state that a rotation preventing member has been interposed between a main frame and an orbiting scroll of the scroll compressor of FIG. 3, and FIG. 6 is a sectional view taken along line 'I-I' in FIG. 5, which illustrates a state that a rotation preventing member has been interposed between a main frame and an orbiting scroll.

As shown, a scroll compressor having a rotation preventing member according to the present invention comprises a main frame 120 fixedly-installed at an inner space 111 of a hermetic casing 110, and a sub frame 130 fixed to one side of the main frame 120 in a horizontal direction. The sub frame 130 may be coupled to an inner circumferential surface of the casing 110, or may be integrally formed with the casing 110.

A shaft accommodating hole 121 for supporting a crankshaft 150 to be later explained in a radius direction is formed at the center of the main frame 120, and a first bearing 122 for supporting the crankshaft 150 in a radius direction is installed at the shaft accommodating hole 121.

A driving motor 140 is fixedly-installed between the main frame 120 and the sub frame 130 at the inner space 111 of the casing 110. A coil may be wound on a stator 141 of the driving motor 140 in a concentrated manner. The driving motor 140 may be implemented as a constant motor having the same rotation speed of a rotor 142. Alternatively, the driving motor 140 may be implemented as an inverter motor having a variable rotation speed of the rotor 142 with consideration of multi functions of a refrigerating apparatus to which the scroll compressor is applied. A crank shaft 150 rotatably coupled to an orbiting scroll 170 to be later explained and transmitting a rotational force of the driving motor 140 to the orbiting scroll 170 is coupled to the rotor 142 of the driving motor 140. The crankshaft 150 is supported by the main frame 120 and the sub frame 130 fixedly-installed at right and left sides of the casing 110. Inside the crankshaft 150, an oil passage 151 is long formed along a shaft direction.

A fixed scroll 160 is fixedly-coupled to one side surface of the main frame 120. The fixed scroll 160 is provided with an end plate 161 of a disc shape so as to be fixed to the main frame 120, and a fixed wrap 162 for forming compression chambers (P) is formed on a bottom surface of the end plate 161. A suction recess (not shown) directly connected to a suction pipe 112 is formed at the edge of the end plate 161, and a discharge port 163 is formed at the center of the end plate 161.

The orbiting scroll 170 which forms a pair of compression chambers (P) together with the fixed scroll 160 is installed between an upper surface of the main frame 120 and a bottom surface of the fixed scroll 160. The orbiting scroll 170 is provided with an end plate of a disc shape so as to perform an orbital motion between the main frame 120 and the fixed scroll 160. An orbiting wrap 172 which forms the compression chambers (P) by being engaged with the fixed wrap 162 is formed at one side surface of the end plate 171. A boss portion 173 coupled to the crankshaft 150 is protruding from another side surface of the end plate 171.

A rotation preventing member 180 for preventing a rotation of the orbiting scroll 170 but allowing only an orbital motion with a rotational force received from the driving motor 140 is installed between the orbiting scroll 170 and the main frame 120.

As shown in FIGS. 4 to 6, the rotation preventing member 180 is provided with a ring portion 181 having a predetermined thickness and width, and formed in a ring shape. At one side surface of the main frame 120, i.e., at the periphery of the shaft accommodating hole 121, formed is a mounting portion 123 stepped from a thrust bearing surface in a ring shape, such that the rotation preventing member 180 is inserted thereinto to be movable on a plane. The mounting portion 123 consists of a bottom surface 1231 on which the rotation preventing member 180 is disposed, and a side wall surface 1232 extending from the bottom surface 1231 to a direction of the thrust bearing surface and which constitutes an inner circumferential surface of the mounting portion 123 such that a first guide surface 125 to be later explained is formed.

Two side surfaces of the ring portion 181 in an axial direction, i.e., a first thrust surface 182 and a second thrust surface 183 sliding-contacting the mounting portion 123 of the main frame 120 and a thrust surface 175 of the orbiting scroll 170 are not provided with additional keys respectively, but are formed to be flat.

One side surface of the ring portion 181 in an axial direction is provided with a first thrust surface 182 contacting the main frame 120, and another side surface of the ring portion 181 in an axial direction facing the first thrust surface 182 is provided with a second thrust surface 183 contacting the orbiting scroll 170. Accordingly, the mounting portion 123 of the main frame 120 and the thrust surface 175 of the orbiting scroll 170 facing the first thrust surface 182 and the second thrust surface 183, respectively are formed to be flat without additional key recesses.

First sliding surfaces 184 are formed at both sides of an outer circumferential surface of the ring portion 181, so as to slide on a plane to a first direction, with respect to an inner circumferential surface of the mounting portion 123 of the main frame 120, i.e., the side wall surface 1232. And, first guide surfaces 125 are formed at both sides of an inner circumferential surface of the mounting portion 123 so that the first sliding surfaces 184 of the rotation preventing member 180 may slide on a plane to a first direction. The first guide surfaces 125 are formed in parallel on a plane to a first direction (upper and lower directions in FIG. 6). As shown in FIGS. 5 and 6, the first sliding surfaces 184 and the first guide surfaces 125 may be formed to have an overlapped height based on a horizontal section, more preferably, may be formed on the same plane. Here, a virtual line extending from the first guide surface 125 and a virtual line extending from the second guide surface 176 to be later explained may be formed to cross each other.

Second sliding surfaces 185 are formed at both sides of an inner circumferential surface of the ring portion 181, so as to slide on a plane to a second direction, with respect to the orbiting scroll 170. And, second guide surfaces 176 are formed at both sides of an outer circumferential surface of a boss portion 173 of the orbiting scroll 170, so that the second sliding surfaces 185 of the rotation preventing member 180 may slide on a plane to a second direction. The second guide surfaces 176 are formed in parallel on a plane to a second direction (right and left directions in FIG. 6). As shown in FIGS. 5 and 6, the second sliding surfaces 185 and the second guide surfaces 176 may be formed to have an overlapped height with the first sliding surfaces 184 and the first guide surfaces 125, based on a horizontal section, more preferably, may be formed on the same plane.

A virtual line extending from the second sliding surfaces 185 are formed in a direction perpendicular to a virtual line extending from the first sliding surfaces 184. However, the A virtual line extending from the second sliding surfaces 185 may not be necessarily formed in a direction perpendicular to the A virtual line extending from the first sliding surfaces 184, but may be formed to be crossed to the A virtual line extending from the first sliding surfaces 184.

The first sliding surfaces 184 are formed to have a length shorter than that of the first guide surfaces 125, whereas the second sliding surfaces 185 are formed to have a length shorter than that of the second guide surfaces 126. This may prevent a rotation of the orbiting scroll 170 as the rotation preventing member 180 performs a sliding motion with respect to the main frame 120 and the orbiting scroll 170.

As shown in FIG. 6, a plurality of the first sliding surfaces 184 are formed to be symmetrical to each other based on a first direction center line of the ring portion 181. And, a plurality of the second sliding surfaces 185 are formed to be symmetrical to each other based on a second direction center line of the ring portion 181.

Unexplained reference numeral 112 denotes a suction pipe, 113 denotes a discharge pipe, 122, 131, and 174 indicate bearings, and 193 denotes a check valve.

The operation of the scroll compressor will be explained as follows.

Once power is supplied to the driving motor 140, the crankshaft 150 rotates together with the rotor 142 to transmit a rotational force to the orbiting scroll 170.

Then, the orbiting scroll 170 performs an orbital motion on a thrust bearing surface of the main frame 120 by an eccentric distance, by the rotation preventing member 180. As a result, a pair of compression chambers (P) which consecutively move are formed between the fixed wrap 162 and the orbiting wrap 172.

Due to a continuous orbital motion of the orbiting scroll 170, the compression chambers (P) move to the center to have a decreased volume. Accordingly, a refrigerant sucked to the compression chambers (P) through the suction pipe 112 is compressed, and then is discharged to the inner space 111 of the casing 110 through the discharge port 163 communicated with the final compression chamber. The discharged refrigerant is moved to a refrigerating cycle through the discharge pipe 113.

The rotation preventing member 180 of a ring shape is provided between the main frame 120 and the orbiting scroll 170, thereby preventing a rotation of the orbiting scroll 170 which receives a rotational force from the driving motor 140, but allowing only an orbital motion of the orbiting scroll 170.

Figure 7:
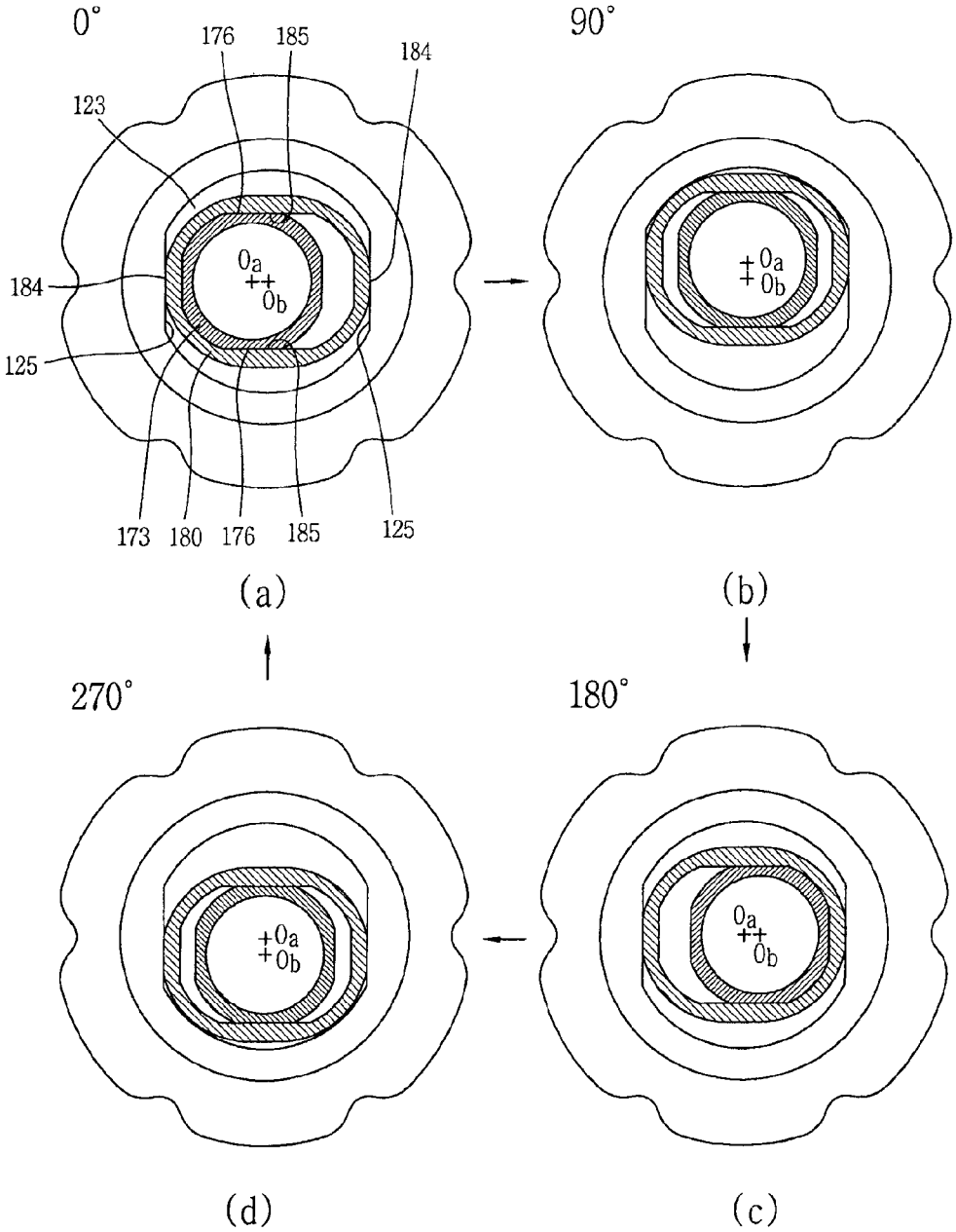
FIG. 7 is a planar view illustrating processes that an orbiting scroll of the scroll compressor of FIG. 3 is prevented from rotating by a rotation preventing member.

FIG. 7 is a planar view illustrating processes that the orbiting scroll of the scroll compressor of FIG. 3 is prevented from rotating by the rotation preventing member.

As shown in FIG. 7, the orbiting scroll 170 is rotatably coupled to the crankshaft 150 in a state eccentric from the center of the crankshaft 150, and receives a rotational force from the crankshaft 150. Therefore, the orbiting scroll 170 tends to rotate as well as to perform an orbital motion centering around the crankshaft 150, on an upper surface of the main frame 120.

The first sliding surfaces 184 are formed, in parallel, on two outer sides of the rotation preventing member 180 inserted into the mounting portion 123 of the main frame 120 in the form of straight lines. And, the first guide surfaces 125 are formed, in parallel, on two sides of an inner circumferential surface of the mounting portion 123. This may prevent a rotation of the orbiting scroll 160, and cause the orbiting scroll 170 to slide to the first direction where the first sliding surfaces 184 and the first guide surfaces 125 are formed, i.e., the upper and lower directions.

At the same time, the second sliding surfaces 185 are formed in parallel, in the form of straight lines, on an inner circumferential surface of the rotation preventing member 180, in a direction perpendicular to the first sliding surfaces 184. And, the second guide surfaces 176 are formed in parallel, in the form of straight lines, on an outer circumferential surface of the boss portion 173 inserted into the mounting portion 123 together with the rotation preventing member 180, in correspondence to the second sliding surfaces 185. This may prevent a rotation of the orbiting scroll 170, and may cause the orbiting scroll 170 to slide to the second direction where the second sliding surfaces 185 and the second guide surfaces 176 are formed, i.e., the right and left directions.

Under these configurations, as shown in FIGS. 7A to 7D, the orbiting scroll 170 does not perform a rotation by the rotation preventing member 180, but performs an orbital motion despite a rotational force received from the driving motor 140. In FIG. 7, Oa indicates the center of the crankshaft, and Ob indicates the center of the boss portion of the orbiting scroll.

In the conventional art, a plurality of keys are formed on upper and lower surfaces of the rotation preventing member, and key recesses are formed at the main frame and the orbiting scroll. This may cause a difficulty in fabricating the rotation preventing member, and may cause an unstable behavior of the orbiting scroll. However, in the present invention, upper and lower surfaces of the rotation preventing member are not formed to be flat, but are formed to be provided with sliding surfaces. This may prevent a rotation of the orbiting scroll, thereby facilitating a processing of the oration preventing member. Furthermore, even if a tilting moment occurs at the orbiting scroll, the rotation preventing member is not inclined. This may effectively prevent tilting of the orbiting scroll, and thus reduce partial frictions and noise.

Another embodiment of the scroll compressor according to the present invention will be explained as follows.

Figure 8:
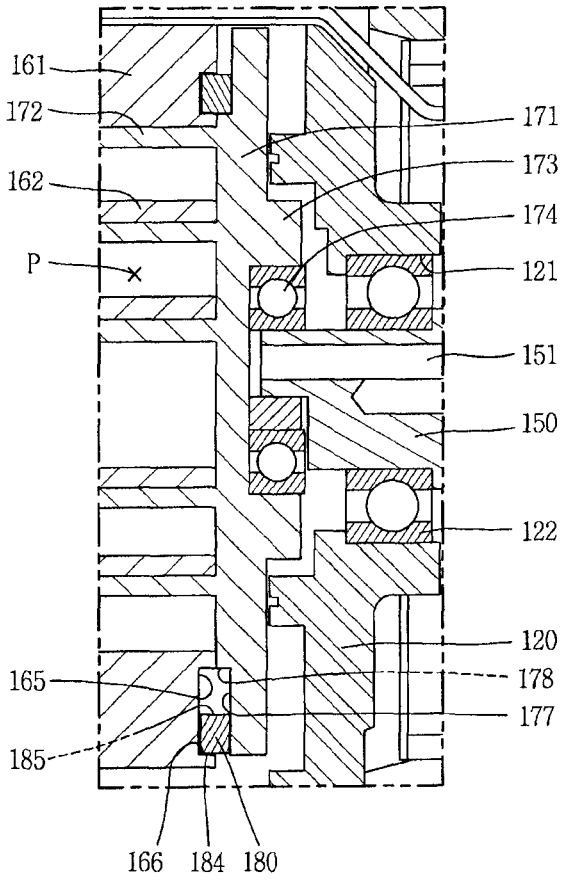
FIG. 8 is a longitudinal sectional view illustrating another embodiment of an installation position of a rotation preventing member of the scroll compressor of FIG. 3.

In the aforementioned embodiment, the rotation preventing member is installed between the main frame and the orbiting scroll. However, in this embodiment, as shown in FIG. 8, the rotation preventing member 180 may be installed between the fixed scroll 160 and the orbiting scroll 170.

In this case, the ring portion 181 of the rotation preventing member 180 may be formed in a ring shape, and the first thrust surface 182 and the second thrust surface 183 are formed on upper and bottom surfaces of the ring portion 181, respectively. The first sliding surfaces 184 and the second sliding surfaces 185 may be formed on an outer side surface and an inner side surface of the ring portion 181, respectively. A mounting portion 165 may be formed on a thrust bearing surface of the fixed scroll 160, and a first guide surface 166 may be formed on an inner circumferential surface of the mounting portion 165. And, a mounting portion 177 may be formed on a thrust bearing surface of the orbiting scroll 170 in the form of a boss portion, and a second guide surface 178 may be formed on an outer circumferential surface of the mounting portion 177.

In this embodiment, the scroll compressor has the same configuration and effects as those of the aforementioned embodiment, except that the rotation preventing member is disposed between the fixed scroll and the orbiting scroll. This may allow the orbiting scroll to have a more stable behavior by being stably supported by the main frame.

What is claimed is:

1. A rotation preventing member of a scroll compressor, comprising:

a rotation preventing member disposed between a fixed member and a movable member, and configured to prevent a rotation of the movable member, and configured to allow the movable member to perform an orbital motion with respect to the fixed member, wherein the rotation preventing member comprises:

a ring portion formed in a ring shape;

one or more first sliding surfaces formed on an inner circumferential surface or an outer circumferential surface of the ring portion in a first direction, and slidably coupled to the movable member; and one or more second sliding surface formed, in a second direction, on one of the inner circumferential surface and the outer circumferential surface of the ring portion where the first sliding surface is not formed, and slidably coupled to the fixed member, wherein a virtual line extending from the first sliding surface and a virtual line extending from the second sliding surface are formed to cross each other, wherein each of the first sliding surface and the second sliding surface is formed in plurality, wherein the plurality of first sliding surfaces are formed in parallel on circumferential surfaces symmetrical to each other based on a center line through the ring portion in the first direction, and the plurality of second sliding surfaces are formed in parallel on circumferential surfaces symmetrical to each other based on a center line through the ring portion in the second direction, and wherein the ring portion has a first thrust surface contacting the fixed member, and a second thrust surface formed at an opposite side to the first thrust surface and contacting the movable member, the first thrust surface and the second thrust surface are formed to be flat.

2. The rotation preventing member of claim 1, wherein the first sliding surface and the second sliding surface are formed on a plane having an overlapped height based on a horizontal section.

3. A scroll compressor, comprising:

a casing;

a driving motor including a rotor and a stator;

a frame fixedly-installed at an inner space of the casing;

a fixed scroll fixedly-installed at the frame;

an orbiting scroll installed to be movable with respect to the fixed scroll, and coupled to the rotor of the driving motor; and a rotation preventing member disposed between the frame and the orbiting scroll or between the fixed scroll and the orbiting scroll, and configured to prevent a rotation of the orbiting scroll, wherein a first guide surface is formed at the frame or the fixed scroll, a second guide surface is formed at the orbiting scroll, a first sliding surface is formed on one of an inner circumferential surface and an outer circumferential surface of the rotation preventing member so as to slidably contact the first guide surface, and a second sliding surface is formed on one of the inner circumferential surface and the outer circumferential surface of the rotation preventing member where the first sliding surface is not formed so as to slidably contact the second guide surface, and wherein the first guide surface, the second guide surface, the first sliding surface, and the second sliding surface are formed on a plane having an overlapped height based on a horizontal section.

4. The scroll compressor of claim 3, wherein a virtual line extending from the first sliding surface and a virtual line extending from the second sliding surface are formed to cross each other.

5. The scroll compressor of claim 4, wherein a mounting portion configured to mount the rotation preventing member is formed at the frame, and a boss portion configured to receive the rotation preventing member is formed at the orbiting scroll, wherein the first guide surface is formed on an inner circumferential surface of the mounting portion, and the second guide surface is formed on an outer circumferential surface of the boss portion, wherein a virtual line extending from the first guide surface and a virtual line extending from the second guide surface are formed to cross each other.

6. The scroll compressor of claim 5, wherein the first guide surface is formed to be longer than the first sliding surface, and wherein the second guide surface is formed to be longer than the second sliding surface.

7. The scroll compressor of claim 5, wherein a thrust surface of the rotation preventing member are formed to be flat, wherein a frame contacting the thrust surface of the rotation preventing member or each thrust surface of the fixed scroll and the orbiting scroll is formed to be flat in correspondence to the thrust surface of the rotation preventing member.

8. The scroll compressor of claim 4, wherein each of the fixed scroll and the orbiting scroll has a mounting portion configured to mount the rotation preventing member, wherein the first guide surface is formed on an inner circumferential surface of the mounting portion of the fixed scroll, and the second guide surface is formed on an outer circumferential surface of the mounting portion of the orbiting scroll, wherein a virtual line extending from the first guide surface and a virtual line extending from the second guide surface are formed to cross each other.

9. The scroll compressor of claim 8, wherein the first guide surface is formed to be longer than the first sliding surface, wherein the second guide surface is formed to be longer than the second sliding surface.

10. The scroll compressor of claim 8, wherein a thrust surface of the rotation preventing member is formed to be flat, wherein a frame contacting the thrust surface of the rotation preventing member or each thrust surface of the fixed scroll and the orbiting scroll is formed to be flat in correspondence to the thrust surface of the rotation preventing member.

11. The scroll compressor of claim 4, wherein the first sliding surface and the second sliding surface are formed to be perpendicular to each other, and wherein the first guide surface and the second guide surface are formed to be perpendicular to each other.

* * * * *